United States Patent [19]

Bomers et al.

[11] 4,043,816

[45] Aug. 23, 1977

[54] PHOTOGRAPHIC PROCESS FOR MAKING DIAZOTYPE COPIES UTILIZING SMALL QUANTITY OF LIQUID DEVELOPER

[75] Inventors: Johannes P. Bomers, Grubbenvorst; Gerardus J. Vosbeek, Velden, both of Netherlands

[73] Assignee: Oce-van der Grinten N.V., Venlo, Netherlands

[21] Appl. No.: 517,527

[22] Filed: Oct. 24, 1974

Related U.S. Application Data

[63] Continuation-in-part of Ser. No. 363,659, May 24, 1973, abandoned.

[30] Foreign Application Priority Data

May 26, 1972 Netherlands ..... 7207099

[51] Int. Cl.[2] ..... G03C 1/58; G03C 5/34

[52] U.S. Cl. ..... 96/49; 96/75; 96/91 R

[58] Field of Search ..... 96/49.75, 91 R

[56] References Cited

U.S. PATENT DOCUMENTS

| | | | |
|---|---|---|---|
| 2,241,104 | 5/1941 | Van der Grinten | 96/49 |
| 2,773,768 | 12/1956 | Sanders et al. | 96/49 |
| 2,792,303 | 5/1957 | Sanders et al. | 96/49 |
| 3,261,684 | 7/1966 | Wilders et al. | 96/49 |
| 3,338,713 | 8/1967 | Hendrickx et al. | 96/49 |
| 3,385,705 | 5/1968 | Dippel et al. | 96/75 |
| 3,446,620 | 5/1969 | Parker | 96/49 |
| 3,615,485 | 10/1971 | Islam et al. | 96/49 |

FOREIGN PATENT DOCUMENTS

| | | | |
|---|---|---|---|
| 800,065 | 11/1973 | Belgium | 96/49 |
| 957,836 | 5/1964 | United Kingdom | 96/49 |
| 957,837 | 5/1964 | United Kingdom | 96/49 |
| 957,838 | 5/1964 | United Kingdom | 96/91 R |

*Primary Examiner*—Charles L. Bowers, Jr.
*Attorney, Agent, or Firm*—Albert C. Johnston

[57] ABSTRACT

Diazotype copies are produced from one-component diazotype material in a practically dry state without adversely affecting their feel or the speed of development. The diazotype material comprises a support and a light-sensitive surface layer having an average maximum thickness of not more than 8 micrometers and comprising 0.2-2 milligram molecules of one or more diazo compounds, which, in vitro, couple more actively than 4-diazo-2-chloro-N.N.-diethylaniline. After imagewise exposure the copy is developed by applying to the light-sensitive surface of the diazotype material a quantity amounting to 1.5 to 4.5 $cm^3/m^2$ of an aqueous, buffered solution, which is at a pH of between 5.5 and 7 and which comprises per liter 0.1-0.6 g.mol of azocoupling component, consisting for at least 50% by weight of phloroglucinol and 1–3 g. equivalents of buffer salt. The diazo layer advantageously is formed by spreading 2–8 $cm^3$ of sensitizing solution of adapted concentration onto the support.

8 Claims, 1 Drawing Figure

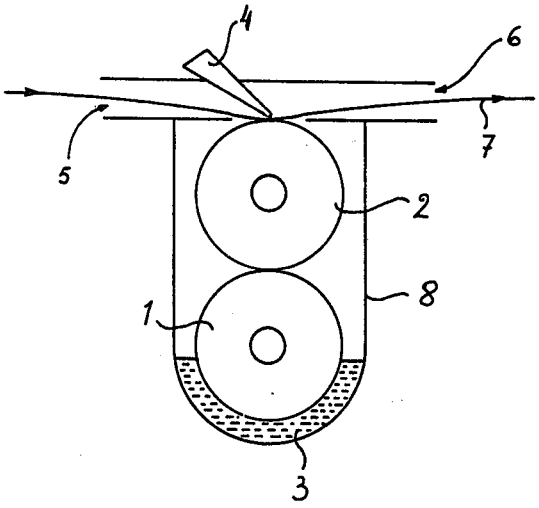
4
6
5
7
2
8
1
3

PHOTOGRAPHIC PROCESS FOR MAKING DIAZOTYPE COPIES UTILIZING SMALL QUANTITY OF LIQUID DEVELOPER

This application is a continuation-in-part of copending application Ser. No. 363,659 filed May 24, 1973 and now abandoned.

The present invention relates to a process for making copies, of the kind in which a diazotype material consisting of a support coated with a light-sensitive layer containing a light-sensitive diazo compound is developed after imagewise exposure by spreading a buffered aqueous solution of an azo-coupling component uniformly over the diazo layer.

In the diazotype art two difference process systems are well known, such as described in detail in J. Kosar, "Light-Sensitive Systems" (John Wiley and Sons, Inc., New York/London/Sydney, 1965), pages 194 et seq.

In the dry or ammonia process a diazotype material is used in which a light-sensitive diazonium compound and an azo-coupling component are present in one layer. This layer also contains an acid stabiliser. After imagewise exposure this material is developed by the action of moist ammonia gas, so that the diazonium compound left in the unexposed portions couples with the azo-coupling component to yield an azo-dyestuff.

The unpleasant and pungent odour of ammonia is to be considered as a major disadvantage of this process. To avoid that too much ammonia gas penetrates into the work-shop, the copying apparatus used with this process should be fitted with an exhaust system. However, the copies always keep smelling of ammonia for a long time.

In the semi-wet process a diazotype material is applied of which the light-sensitive layer only comprises the diazonium compound, with or without an acid stabiliser and other additives. The copy is developed by spreading a thin layer of a buffered aqueous solution of an azo-coupling component uniformly over the diazo-layer.

In practice the amount of azo-coupling component solution or developer applied amounts to 7–8 $cm^3$ per square meter per side. This quantity is necessary to obtain a uniform application of the developer as well as a fast and complete development with the usual developing devices and diazotype materials. Generally an almost equal amount of developer is also applied to the reverse side of the copying material, in order to prevent curling.

A copy developed in this way contains a lot of moisture. As a matter of fact, a few copies can be air-dried but if great numbers of copies have to be made successively, a drying device is indispensable. Such a drying device requires a high heating capacity, particularly in fast working copying apparatus. Moreover, it takes a considerable time before the drying device will have reached the desired drying temperature. This results in an undesired waiting period, before the copying apparatus can be put into use. Therefore, attempts to find a developing process, capable of producing dry or practically dry copies, but without having the disadvantages of the ammonia process, have already been made for a long time.

To that end the U.S. Patent Specification 1,841,653 proposes to apply the developing liquid with the aid of squeezing rollers. By means of two rubber-covered rollers an excess of developer is applied, which is again immediately squeezed off by the same rollers. According to this Patent Specification the copy thus obtained is practically dry. In fact, however, the developer has entirely penetrated into the copying material, so that it contains a rather considerably amount of moisture. Consequently, for fast working copying apparatus a drying device is indispensable.

Another solution has been proposed in the British Patent Specification 1,143,702. According to the process described in that Patent Specification a two-component diazotype material is used, as also applied in the ammonia process. Development, however, is accomplished by applying a controlled amount of maximally 3 $cm^3$ per square meter of an alkaline liquid, which contains at least 20% of an aliphatic amine. The copies obtained in this way are immediately dry, but the copy feels somewhat fatty. An additional disadvantage is the relatively slow development, which is caused by the fact, that in general slowly coupling diazonium compounds are applied in the two-component material used, and probably also because the viscous developer penetrates rather slowly into the material to be developed.

For the production of copies a process has now been found in which dry copies are obtained immediately and in which the disadvantages inherent to the above mentioned processes are not applicable. According to the invention a process for making diazotype copies is provided, which process comprises imagewise exposing a diazotype material, comprising a support and a light-sensitive surface layer, said surface layer having an average thickness of not more than 8 micrometers and comprising between 0.2–2 milligram molecules per square meter of one or more diazo compounds, which, in vitro, couple more actively than 4-diazo-2-chloro-N.N.-diethylaniline, and thereafter applying to said light-sensitive surface layer a quantity of between 1.5 and ;b 4.5 $cm^3$ per square meter of a buffered aqueous developing solution which is at a pH of between 5.5 and 7 and which contains 0.1–0.6 g.mol of azo-coupling component, predominantly consisting of phloroglucinol, and 1–3 g. equivalents of buffer salt per liter, so as to form an azo-dyestuff image in the unexposed areas of the said diazotype material.

The diazotype copies obtained in the process according to the invention immediately feel dry, because the small quantity of moisture applied, evaporates in a very quick, spontaneous way so that even in a fast working copying apparatus no drying device is required.

In the process according to the invention azo-dyestuff formation proceeds rapidly and has almost completed a few seconds after the application of developing liquid has finished.

According to the invention use is made of a diazotype material which comprises a support and a light-sensitive surface layer, which surface layer has an average thickness of not more than 8 micrometers and comprises between 0.2 and 2 milligram molecules per square meter of a diazo compound, which, in vitro, couples more actively than 4-diazo-2-chloro-N.N.-diethylaniline.

The diazotype material may be provided by applying to a support of paper of other material, for instance film material, a layer of a hydrophobic cellulose ester or polyvinyl ester, superficially hydrolyzing the cellulose ester or polyvinyl ester film layer to an average depth of not more than 8 micrometers, and preferably to a depth of 4 to 5 micrometers, and finally sensitizing the hydrolyzed surface layer with the actively coupling diazo compound.

The diazotype material may also be obtained by superficially hydrolyzing a self-supporting film of a cellulose ester, for instance cellulose di- or triacetate, and subsequently sensitizing the hydrolyzed layer of the film.

Diazotype materials of this type, which are highly suited for use in the process according to the invention are for instance described in British Patent Specification 957,836.

One-component diazotype papers, in which the diazo compound is not present in a hydrophilic film layer, are usually produced by applying to a paper support, which, if necessary, may be precoated, 10 to 15 $cm^3$ per square meter of an aqueous solution of a diazo compound. The diazotype papers thus obtained are not suited for use in the process according to the invention, because the sensitizing solution has penetrated too deeply in the paper support and, by consequence, a substantial amount of the diazo compound is located deeply in the paper support.

As image development in the process according to the invention is accomplished with a quantity of developer of between 1.5–4.5 $cm^3$ per square meter, the azo-coupling component cannot penetrate so deeply into the paper. The result is that image development does not proceed completely. Generally, an amount of diazo compound not exceeding about 70 percent is converted into azo-dyestuff.

Diazotype papers for use in the process according to the invention can be provided by first coating the paper support with a hydrophobic barrier layer, and then applying a more or less hydrophilic layer of the desired thickness, i.e. not more than 8 micrometers, onto the barrier layer. The diazo compound can be applied simultaneously with the ingredients for forming the hydrophilic layer, or afterwards. In this way too deep a penetration of the diazo compound is prevented. The composition of the material than looks like that of the film materials as described in British Patent Specification 957,836.

It has now been found, however, that too deep a penetration of the diazo compound can also be prevented by sensitizing the material with a smaller quantity of sensitizing solution than 10 to 15 $cm^3$. It has been found that a light-sensitive surface layer with an average depth of not more than 8 micrometers can be formed on a paper support, if the sensitization of the support is carried by applying thereto 2–8 $cm^3$, and preferably about 3 $cm^3$, per square meter of sensitizing solution, which contains an adapted higher concentration of diazo compound. In this way the diazo compound will penetrate approximately to the same depth and in the way as the azo-coupling component does upon image development. Diazotype papers sensitized in this way develop almost completely in the process according to the invention. Upon development 95–100% of the diazo compound in the image areas of the diazotype paper is converted into azo-dyestuff.

To show the effect of this method of sensitizing, a number of diazotype papers sensitized in the usual way with 10 to 15 $cm^3$ per square meter and a number of diazotype papers sensitized according to the invention by applying 3 $cm^3$ per square meter of a sensitizing solution containing an adapted higher concentration of diazo compound were completely developed, using the developing solution described in example I. Sections were cut out of the developed papers, such that the cross-section of the azo-dyestuff layer could be viewed under a microscope. The thickness of the dyestuff layer proved to vary from place to place. Therefore, the layer thickness was measured in a great number of places and the arithmetical average was calculated from the results of these measurements. This average is here referred to as the average maximum layer thickness. The diazotype papers sensitized with 10 to 15 $cm^3$ per square meter proved to have an average maximum layer thickness of 9–12 micrometers.

The average maximum layer thickness of the diazotype papers sensitized according to the invention ranged from 5.5 to 7.5 micrometers. If, in the manufacture of diazotype papers for use in the process according to the invention the diazo compound is applied directly to the paper support, the surface texture of the paper may become visible on the copy in the form of a non-uniform distribution of the azo-dyestuff. This disadvantage can be avoided by providing the paper surface with a precoat, as known per se. Such a precoat generally consists of an inorganic or organic filler, such as silica, aluminum oxide, a metal silicate, starch and rice starch, and a binder, such as casein, polyvinyl alcohol, gelatin, gum arabic, polyvinyl acetate and the like.

Surprisingly it has appeared, that also for diazotype materials in which the diazo compound is present in a hydrophilic film layer, the sensitization with 2–8 $cm^3$ of sensitizing solution per square meter in stead of 10–15 $cm^3$ per square meter, has a favourable effect on the developing speed and on the complete development of the diazotype material.

From sections of the completely developed materials it appears also in this case that the diazo compound is located nearer to the surface if the material has been sensitized by applying 2–8 $cm^3$ per square meter of diazo solution of an adapted higher concentration.

In the process according to the invention completely or almost completely developed images are obtained with diazotype materials containing up to 2 milligram molecules of diazo compound per square meter. For obtaining azo-dyestuff images of sufficient density and contrast a diazo content in the diazotype material of 2 milligram molecules per square meter is however not required, though it of course may be used. Preferably the diazotype material contains 0.2 to 0.5, and more preferably about 0.4, milligram molecules of diazo compound per square meter, if the light-sensitive layer is present on an opaque support and the layer is not a film layer, and 0.8–1.5, more preferably 1–1.2 milligram molecules per square meter, if the light-sensitive layer is present on a transparent or translucent support and/or the layer is a film layer. It will of course be clear, that, for obtaining complete azo-dyestyff formation upon image development, a sufficient amount of azo-coupling component must be applied to the light-sensitive surface of the diazotype material. Thus, the content of azo-coupling component in the developing liquid must be chosen in accordance with the diazo content of the diazotype material and the amount of developing liquid applied to the light-sensitive surface in the developing step.

The diazo compound in the diazotype material for use in the process according to the invention couples in vitro more actively than 4-diazo-2-chloro-N.N.-diethylaniline. The comparative coupling activity of diazo compounds can be determined in vitro by determining the time in which a given portion (e.g. 50%) of the diazo compound to be examined will have coupled in a given molar concentration (e.g. 0.1 millimolar) with the coupling component 1-(p-sulfophenyl)-3-methylpyrazol-5-one in a given molar concentration (e.g. 2.0 millimolar) in a buffer mixture of a given composition and given pH value at a given temperature. This time can be found by interpolation from the data obtained by measurement of, for example, the decreasing absorption of the diazo compound or the increasing absorption of the azo-dyestuff formed for light of wavelengths at which these compounds have high absorption. For the measurement samples are taken from the reaction mixture at regular intervals and made strongly acid with hydrochloric acid in order to stop the coupling reaction. The absorption of the diazo compound along and that of the azo-dyestuff alone, in the same strongly acid medium, are of course also determined. By dividing the number 1000 by the time found (in seconds) a coupling activity value is obtained, which is higher according as the coupling activity is greater.

Examples of diazo compounds which, in vitro, couple more actively than 4-diazo-2-chloro-N.N.-diethylaniline are found for instance in British Patent Specifications 919,037, 919,812, 959,836, 1,045,242, 1,064,128 and 1,064,129.

Some diazo compounds preferably used are, for example:

1-diazo-4-benzoylamino-2.5-dibutoxy-benzene
1-diazo-2.5-diethoxy-4-(4'-methyl)phenyl-benzene
1-diazo-2.5-dimethoxy-4-(4'-methyl)phenylthio-benzene
1-diazo-2.5-diethoxy-4-(4'-methyl)phenylthio-benzene
1-diazo-4-dimethylamino-3-(4'-chloro)phenoxy-6-chloro-benzene
1-diazo-4-dimethylamino-3-(4'-chloro)phenoxy-2-chloro-benzene
1-diazo-2-(ethoxycarbonyl)(benzyl)amino-4-(methyl)-(cyclohexyl)amino-3-methoxy-benzene
1-diazo-4-benzoylamino-2-(ethoxycarbonyl)(methyl-)amino-5-methoxy-benzene
1-diazo-2-(ethoxycarbonyl)(methyl)amino-5-methoxy-4-(4'-methyl)phenylthio-benzene The diazo compounds are preferably used in the form of a readily water soluble salt, e.g. as the hydrogen sulfate or as the chloride. The light-sensitive diazo layer may of course contain more than one diazo compound. Moreover the usual auxiliary agents, such as acids and stabilisers, e.g. the sodium salt of 1,3,6-naphthalene trisulfonic acid, reducing agents, e.g. thiourea, etc. may be present in the light-sensitive layer.

As developing liquid in the process according to the invention use is made of aqueous weakly acid, buffered solutions, which are at a pH between 5.5 and 7 and contain 0.1–0.6 g.mol of azo-coupling component, consisting for at least 50% by weight of phloroglucinol, and 1 to 3 g. equivalents of buffer salt per liter. The azo-coupling component in the developing liquid consists for at least 50% by weight of phloroglucinol, which is a very actively coupling azo-component forming, in a weakly acid medium, dark azo-dyestuffs with most actively coupling diazo compounds as above defined. In addition to phloroglucinol other actively coupling azo-coupling components, well known for use in diazotype developing solutions such as resorcinol an acetoacetanilide, may be used. Preferably the developing liquid comprises as azo-coupling components a mixture of about 60% by weight of phloroglucinol and about 40% by weight of resorcinol. The total quantity of azo-coupling component in the developing liquid solution must amount between 0.1 and 0.6 g.mol per liter.

As buffer salt the developing solution may contain the buffer salts well known per se for buffering aqueous diazotype developing solutions. Preferred buffer salts are the alkali metal, magnesium and ammonium salts of dibasic organic carboxylic acids such as succinic, glutaric, adipic, $\beta$-methyladipic, maleic, malonic acids and of citric acid. Among these buffer salts, the salts derived from succinic acid are mostly preferred. Examples of these and other suited buffer salts are found for instance in British Patent Specification 957,836 and French Patent Specification 1,347,703. Of course, the developing liquids may contain mixtures of buffer salts. The total quantity of buffer salt in the developing liquid amounts between 1.5 and 3 g. equivalents per liter. By 1 g. equivalent of buffer salt is to be understood the quantity of salt which is obtained from 1 g. equivalent of acid from which the buffer salt is derived.

The developing liquids may further contain the conventional substances preventing them from yellowing, antioxydants, developing accelerators and wetting agents.

The amount of developing liquid spread over the diazo layer upon development, depends on the surface texture, the hydrophility and the porosity of the diazotype material to be developed. A smoother layer absorbs less developer than a somewhat coarser layer.

The quantity applied to lacquered materials, the support of which consists of a synthetic foil, e.g. a polyester foil, or of a transparent paper, which support is provided with a hydrophilic film layer, and optionally with a hydrophobic intermediate layer, for example a superficially saponified cellulose-ester layer, amounts to approximately 1.5 – 3.0 $cm^3$ per square meter. These film materials contain more diazonium compound per surface unit than diazotype papers. For a complete development of these materials a definite minimum quantity of developer has to be applied. If the developing device for these film materials has been adjusted to the proper amount to be applied, the application on paper will be higher, which means that an excess of azo-coupling component is applied on diazotype paper.

Consequently, the quantity of developing liquid applied on ordinary opaque materials having a paper support with or without a precoat, amounts to 2.5 – 4.5 $cm^3$ per square meter, preferably 2.5 – 3.5 $cm^3$ per square meter.

The minima mentioned result from the requirement that it must be possible to spread the developing liquid uniformly over the diazo-layer, whereby the entire surface is wetted. The upper limits result from the requirement, that the material feels dry when it leaves the developing device.

Although in literature different devices are described with which such a small quantity of liquid can uniformly be spread over a surface, the best results with the process according to the invention are obtained with the device described below which means, that all the materials mentioned above can be processed well and that the application of developer is uniform and constant.

This device is shown schematically in the accompanying drawing. In the FIGURE shown in the drawing, 1 is a dosing roller which is provided with a structured surface and which is partially immersed in the developing liquid 3. The structure may be obtained by making a groove of spiral shape along the entire length of the roller. 2 is the application roller. The surface is elastic, not porous, and has a suitable hardness, generally of 10° - 50° Shore A, preferably of 25° - 35° Shore A. 4 is a pressure blade, of which preferably, at least the part contacting the application roller, is manufactured from an elastic material, e.g. Teflon. To counteract the formation of a liquid meniscus and wetting of the rear side of the copy, the edge of the pressure blade is preferably provided with U-shaped incisions.

Also means removing the pressure blade from the application roller, if there is no copy between this blade and the roller, may be provided.

Instead of a pressure blade, a pressure roller, the surface of which contains projections precluding wetting of the pressure roller and, consequently, wetting of the rear side of the developed material, may also be applied.

5 and 6 respectively are the feed-in and feed-out gaps for the diazotype material. 7 represents the copying material to be developed. 8 constitutes a closing which serves to prevent the evaporation of water from the developer.

The copy to be developed is conveyed between the application roller 2 and the pressure blade 4 with the light-sensitive side downwards.

When the device is operating, developing liquid is supplied by the dosing roller 1 to the application roller 2. This picks up a part of the developing liquid and transports this to the copy to be developed. This picks up a quantity of the developing liquid from roller 2, which quantity is i.a. dependent on the material to be developed.

The quantity of developing liquid which is applied on a certain material, for instance paper, depends i.a. on the surface structure of the dosing roller 1, the hardness and hydrophility of the surface of the application roller 2, the pressure between application roller 2 and dosing roller 1, and the pressure between pressure blade 4 and application roller 2. Therefore all these magnitudes must be turned to each other, and many suitable combinations are possible. For instance, a developing device was manufactured, of which the dosing roller was provided with a groove with a depth of 25 μm and a pitch of 0.3 mm. This groove had a triangular cross-section. The upper width was 50 μm. The surface of the application roller was formed by a polished rubber with a hardness of 25° Shore A. The pressure between dosing roller and application roller amounted to 7 grams per running millimeter, and the pressure between pressure blade and application roller amounted to 4 grams per running millimeter.

This developing device produced an application of developing liquid which up to a transport speed of 20 m/min. of the material to be developed kept constant, namely between 3.5 and 4 $cm^3$ per square meter on paper and between 1.5 and 2 $cm^3$ per square meter on film.

In general the pressure between pressure blade and application roller should amount to 2 - 10 g/mm, and preferably to 3 - 5 g/mm. The pressure should have a certain minimum value in order to obtain a good uniform humidification. If this pressure is too high, the developer-application on film materials becomes too low. The application roller should be covered with a material with a hardness of at most 50° Shore A, and preferably of 25° - 35° Shore A. This is necessary in order to obtain a uniform humidification at different thicknesses of the material to be developed and at tolerances in the pressure blade and in the rollers used. The pressure between application roller 2 and dosing roller 1 amounts to 3 - 9 g/mm, and preferably to 5.5 - 7.5 g/mm. The surface-structure of the dosing roller, that means the total cross-section of the holes made per running millimeter, must finally be chosen in such a way that the desired developer-application is achieved at the pressures applied. This structure may not be too coarse, because then this structure would become more or less visible on the final copy, because the developer can then no more spread itself enough uniformly over the application roller. In the above example the total gap of the groove, seen over the length-section of the roller, amounted to about 2,000 $\mu m^2$/mm.

In the process according to the invention the developing liquid is preferably only applied on the diazo-layer. For that reason diazotype paper tends to curl backwards, that is with the light-sensitive side outwards. This curl has disappeared within a short time. If so required, this curl can be decreased, or the duration of this phenomenon can be reduced. The paper can for instance be made less accessible to water by applying a precoat which more or less forms a barrier on the paper surface.

EXAMPLE I.

On a base paper for the diazotype process a precoat was applied at one side in the known way, which precoat consists of:

10 g of a crystalline silica with a particle size of 5 μm, 6 $cm^3$ of a 50 percent by weight emulsion of polyvinyl acetate, to which water was added to obtain a total quantity of 100 $cm^3$.

The coating was effected by uniformly distributing 15 $cm^3/m^2$ of this mixture over the paper and drying the layer. The precoated side was sensitized by uniformly spreading 3 $cm^3/m^2$ of a 0.14 molar diazo solution in water over the surface and by drying. In the diazo solution a mixture of two diazo compounds was used, namely:

4-dimethylamino-3-(4'-chloro)phenoxy-6-chloro-benzene diazonium-hydrogensulfate 2,5-diethoxy-4-(4'-methyl)phenylthio-benzene-diazonium-hydrogensulfate in a weight-proportion of 2 : 1. The diazotype material thus obtained was exposed under a transparent original and was subsequently developed by uniformly spreading 3 $cm^3/m^2$ of a solution of the following composition over the diazo-layer with the developing device represented in the drawing:

160 g of dipotassiumsuccinate (calculated as water-free)

20 g of phloroglucinol 2 aq.

10 g of resorcinol

1 $g_3$ of Aerosol AY (wetting agent of American Cyanamid Co.)

1000 $cm^3$ of water.

The pH of this solution was brought on 6.8 by adding succinic acid. The solution contained 0.9 moles (i.e. 1.8 g. equivalents) of succinate and 0.2 moles of azo-coupling component per liter.

Immediately after development the copy was dry to the touch and showed a strong, black image, which hardly contained any non-reacted diazonium compound.

EXAMPLE II

A cellulose-acetate film layer of about 20 $g/m^2$, applied on natural transparent paper of about 80 $g/m^2$, was hydrolysed superficially to a depth of about 5 μm, by treatment with a solution of KOH in a mixture of water and methanol. After the chemicals used for the hydrolysis were removed by washing out with water and by drying, the paper was sensitized by uniformly spreading 3 $cm^3/m^2$ of a 0.35 molar solution of a diazonium salt over the hydrolysed side of the paper. A similar result could be obtained by applying an excess amount of diazo-solution and removing it again after about 1 second, for instance with a high pressure air-blade.

The diazonium salt used was 4-benzoylamino-2-(ethoxy-carbonyl) (methyl)amino-5-methoxy-benzene diazonium-hydrogensulfate. The diazotype material thus obtained was exposed imagewise and developed with the developing liquid of Example I. The developer-application amounted to 2.5 $cm^3/m^2$. The copy thus obtained was immediately dry to the touch and showed a strongly violet to brown image with a very good U.V.-absorption on a clear back-ground.

Almost equal good results were obtained, if image development was carried out by applying on the exposed surface of the diazotype paper about 3 $cm^3/m^2$ of a developing liquid comprising:

128 g of maleic acid
18 g of phloroglucinol 2 aq.
10 g of resorcinol
50 ml of glycerol
20 g of sodium benzoate
KOH and water to adjust the pH of the liquid to 6.5 and to make a volume of 100 ml.

We claim:

1. Process for making diazotype copies which comprises imagewise exposing a diazotype material comprising a support and a light-sensitive surface layer, said surface layer having an average thickness of not more than 8 micrometers and comprising between 0.2 and 2 millimoles per square meter of one or more diazo compounds which, in vitro, couple more actively than 4-diazo-2-chloro-N.N.-diethylaniline, and thereafter applying to said light-sensitive surface layer a quantity of between 1.5 and 4.5 $cm^3$ per square meter of a buffered aqueous developing solution which is at a pH of between 5.5 and 7 and which contains, per liter, 0.1–0.6 g. mol of azo-couplng component consisting of at least 50% by weight of phloroglucinol and 1–3 g. equivalents of buffer salt, thereby obtaining a copy that immediately feels dry and exhibits an azo-dyestuff image in the unexposed areas of said diazotype material.

2. Process according to claim 1 in which the light-sensitive layer of the diazotype material has been formed by applying 2 to 8 $cm^3$ per square meter of an aqueous solution of one or more diazo compounds over a surface of the support.

3. Process according to claim 1 in which the developing solution comprises an azo-coupling component a mixture of about 60% by weight of phloroglucinol and about 40% by weight of resorcinol.

4. Process according to claim 1 in which the developing solution comprises as buffer salt an alkali metal, magnesium or ammonium salt of a dibasic organic carboxylic acid.

5. Process according to claim 4 in which the dibasic organic carboxylic acid is succinic acid.

6. Process according to claim 1, the azo-coupling component in said developing solution consisting essentially of phloroglucinol or of phloroglucinol and a minor weight proportion of resorcinol.

7. Process for making diazotype copies, which comprises imagewise exposing a diazotype material comprising a paper support and a light-sensitive surface layer thereon, said surface layer having an average maximum thickness of from 5.5 to 7.5 microns and containing between 0.2 and 0.5 millimoles per square meter of one or more diazo compounds which, in vitro, couple more actively than 4-diazo-2-chloro-N.N.-diethylaniline, said surface layer having been formed by applying 2 to 8 $cm^3$ per square meter of an aqueous solution of said one or more diazo compounds over a surface of said support, and thereafter applying to said light-sensitive surface layer, so as to form an azo-dyestuff image in the unexposed areas of said layer, a quantity of between 2.5 and 3.5 $cm^3$ per square meter of a buffered aqueous developing solution which is at a pH of between 5.5 and 7 and which contains, per liter, 0.1–0.6 g. mole of azo-coupling component comprising resorcinol and at least 50% by weight of phloroglucinol and 1.5–3 g. equivalents of buffer salt comprising at least one salt selected from the group consisting of alkali metal, magnesium and ammonium salts of dibasic organic carboxylic acids.

8. Process for making diazotype copies, which comprises imagewise exposing a diazotype material comprising a film support having a hydrolyzed surface and a light-sensitive surface layer thereon, said surface layer having an average maximum thickness of from 5.5 to 7.5 microns and containing between 0.8 and 1.5 millimoles per square meter of one or more diazo compounds which, in vitro, couple more actively than 4-diazo-2-chloro-N.N.-diethylaniline, said surface having been formed by applying 2 to 8 $cm^3$ per square meter of an aqueous solution of said one or more diazo compounds over said hydrolyzed surface, and thereafter applying to said light-sensitive surface layer, so as to form an azo-dyestuff image in the unexposed areas of said layer, a quantity of between 1.5 and 3.0 $cm^3$ per square meter of a buffered aqueous developing solution which is at a pH of between 5.5 and 7 and which contains, per liter, 0.1–0.6 g. mol of azo-coupling component comprising resorcinol and at least 50% by weight of phloroglucinol and 1.5–3 g. equivalents of buffer salt comprising at least one salt selected from the group consisting of alkali metal, magnesium and ammonium salts of dibasic organic carboxylic acids.

* * * * *

UNITED STATES PATENT OFFICE

CERTIFICATE OF CORRECTION

Patent No. 4,043,816 Dated Aug. 23, 1977

Inventor(s) JOHANNES P. BOMERS and GERARDUS J. VOSBECK

It is certified that error appears in the above-identified patent and that said Letters Patent are hereby corrected as shown below:

Column 2, line 37, omit -- ";b" --.

Column 3, line 38, "than" should be replaced by -- then --.

Column 5, line 13, "along" should be replaced by -- alone --.

Column 9, line 58, "an" should be replaced by -- as --.

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademarks*